US012595661B2

(12) United States Patent
Burt et al.

(10) Patent No.: US 12,595,661 B2
(45) Date of Patent: Apr. 7, 2026

(54) LENGTH ADJUSTABLE RAILING PANEL WITH REMOVABLE UPRIGHT END RAILS

(71) Applicant: PrimeSource Building Products, Inc., Irving, TX (US)

(72) Inventors: Kevin T. Burt, Dallas, TX (US); Kevin B. Flatt, Garland, TX (US); Collin M. Robinson, Garland, TX (US)

(73) Assignee: PrimeSource Building Products, Inc., Irving, TX (US)

( * ) Notice: Subject to any disclaimer, the term of this patent is extended or adjusted under 35 U.S.C. 154(b) by 877 days.

(21) Appl. No.: 17/343,911

(22) Filed: Jun. 10, 2021

(65) Prior Publication Data

US 2022/0396951 A1 Dec. 15, 2022

(51) Int. Cl.
*E04F 11/18* (2006.01)
*E04H 17/14* (2006.01)

(52) U.S. Cl.
CPC ..... *E04F 11/1817* (2013.01); *E04F 11/1836* (2013.01); *E04H 17/1448* (2021.01); *E04H 17/1488* (2021.01); *E04F 2011/1821* (2013.01); *E04F 2011/187* (2013.01)

(58) Field of Classification Search
CPC ..... E04H 17/1447; E04H 17/1448; E04H 17/1465; E04H 17/1488; E04F 11/1834; E04F 2011/1825; E04F 2011/1827; E04F 2011/1829; E04F 2011/1831
USPC ..... 256/67, DIG. 2
See application file for complete search history.

(56) References Cited

U.S. PATENT DOCUMENTS 3,921,960 A 11/1975 Bright
4,691,897 A * 9/1987 Frush ..... E04F 11/1817 403/255
6,299,143 B1 * 10/2001 Valentine ..... E04H 17/1488 256/67

(Continued)

FOREIGN PATENT DOCUMENTS

CN 211549083 U * 9/2020
DE 20 2013 105 162 U1 12/2013

OTHER PUBLICATIONS

International Search Report and Written Opinion on PCT/US2022/032685 dated Oct. 6, 2022; 8 pages.

(Continued)

*Primary Examiner* — Amber R Anderson
*Assistant Examiner* — Zachary A Hall
(74) *Attorney, Agent, or Firm* — Foley & Lardner LLP

(57) ABSTRACT

A railing panel includes a top rail and a bottom rail disposed spaced apart from the top rail. A plurality of slats are disposed between and run parallel to the top rail and the bottom rail. A midspan support rail defines a plurality of through holes, with each through hole receiving a slat therethrough. A length adapter includes an upright end rail that defines a plurality of apertures, and an upper insertable portion that is disposed at a first end of the upright end rail. The length adapter also includes a lower insertable portion that is disposed at a second end of the upright end rail opposite the first end, and each of the plurality of apertures is sized and shaped to receive an end of each of the plurality of slats. A plurality of inserts are coupled to the upright end rail, with each insert disposed proximate a respective aperture of the plurality of apertures, each insert configured to be received by a respective slat.

20 Claims, 11 Drawing Sheets

(56) References Cited

U.S. PATENT DOCUMENTS 6,305,671 B1 10/2001 Valentine
6,494,438 B1 * 12/2002 Noirot ..... E04F 11/1814 256/60
6,874,766 B2 * 4/2005 Curatolo ..... E04F 11/1817 256/64
7,025,335 B2 * 4/2006 Zhu ..... E04H 17/1488 403/252
7,063,186 B1 * 6/2006 Granke ..... E04G 21/3223 182/113
7,077,386 B1 * 7/2006 Gray, Jr. ..... E04F 11/1834 256/65.03
RE39,842 E * 9/2007 Purvis ..... E04G 21/3223 182/113
7,396,002 B1 * 7/2008 Gibbs ..... E04H 17/143 256/67
7,857,292 B2 * 12/2010 Esposito ..... E04H 17/1465 256/22
7,992,841 B2 * 8/2011 Petta ..... E04F 11/1817 24/593.1
8,167,275 B1 * 5/2012 Bizzarri ..... E04F 11/181 256/65.02
8,356,801 B2 * 1/2013 Howard ..... E04H 17/1439 256/22
8,579,263 B2 * 11/2013 Petta ..... E04H 17/16 256/67
8,695,948 B2 * 4/2014 Stinson ..... E04F 11/1817 256/64
8,714,529 B2 * 5/2014 Smith ..... E04F 11/1817 256/67
8,833,737 B2 * 9/2014 Langenwalter ..... E04H 17/1426 256/67
9,027,909 B1 * 5/2015 Peyton ..... E04H 17/1439 256/67
9,797,158 B2 * 10/2017 Springborn ..... E04F 11/1817
9,976,320 B2 5/2018 Burt et al.
2010/0308293 A1 12/2010 Larkins et al.
2011/0140063 A1 6/2011 Sandor, Sr.
2015/0292234 A1 10/2015 Burt et al.

OTHER PUBLICATIONS

Fortress Railing Products, "Installation instructions for FortressCable H-Series Cable Panel System with UB-05 Brackets and Fe$^{26}$ Posts", Mar. 4, 2019, 9 pages.
Extended European Search Report on EP 22820967.2 dated Jul. 11, 2025.

* cited by examiner

LENGTH ADJUSTABLE RAILING PANEL WITH REMOVABLE UPRIGHT END RAILS

CROSS-REFERENCE TO RELATED PATENTS

This application is related to U.S. Pat. No. 9,976,320, entitled "Horizontal Cable Rail Barrier," filed on Apr. 13, 2015, which claims priority to U.S. Provisional Application for Patent No. 61/979,083, filed on Apr. 14, 2014, the disclosures of each of which are incorporated herein by reference.

BACKGROUND OF THE INVENTION

Technical Field of the Invention

The present invention relates generally to barriers (such as railings or fences) and in particular to a railing panel with horizontal or angled slats that has an adjustable length.

Description of Related Art

It is common to form a barrier for railing or fence applications made, for example, of a plurality of panel members, with each panel member supported between and attached to a pair of post members. Each panel generally comprises a bottom rail extending between two posts and a top rail also extending between those same two posts. A plurality of vertical support members (also referred to in the art as pickets or balusters) extend between the bottom rail and the top rail. The bottom rail, top rail and vertical support members are made of a metal material (such as steel or aluminum). In an embodiment, first ends of the vertical support members are fixedly attached to the bottom rail (for example, through brackets or welding) and second ends of the vertical support members are fixedly attached to the top rail (again, for example, through brackets or welding).

The panel may be pre-assembled before delivery to a job site. In such a case, the installer may simply install the pair of posts with a separation substantially equal to a length of the panel. The installed posts may have an exposed height that is greater than a height of the panel. Brackets mounted on each post accept and retain ends of the bottom and top rails. However, situations arise where the distance between the posts is shorter than a length of a panel. In this instance, the panel may be cut to a length that fits between the posts, which would leave top and bottom rail portions extending beyond a baluster at each end. The top and bottom rails may be secured to the posts resulting in a satisfactory railing assembly.

If the balusters extend horizontally, as opposed to vertically, cutting to fit between posts that are spaced apart a distance that is shorter than the manufactured length of the rail panel presents additional challenges.

SUMMARY

In an embodiment, a railing panel includes a top rail and a bottom rail disposed spaced apart from the top rail. A plurality of slats are disposed between and run parallel to the top rail and the bottom rail. A midspan support rail defines a plurality of through holes, with each through hole receiving a slat therethrough. A length adapter includes an upright end rail that defines a plurality of apertures, and an upper insertable portion that is disposed at a first end of the upright end rail. The length adapter also includes a lower insertable portion that is disposed at a second end of the upright end rail opposite the first end, and each of the plurality of apertures is sized and shaped to receive an end of each of the plurality of slats. A plurality of inserts are coupled to the upright end rail, with each insert disposed proximate a respective aperture of the plurality of apertures, each insert configured to be received by a respective slat.

According to one embodiment, the railing panel may be a level railing panel with top and bottom rails and slats running horizontally. The inserts may be biased to exert a force on an internal surface of a wall of the slats. The biased inserts may inhibit rattling of the slats.

According to an alternate embodiment, the railing panel may be an inclined railing panel with top and bottom rails and slats running at a nonperpendicular rake/rack angle. The inserts may be pivotable to accommodate the slats running a range of rake angles. A pivot pin may be received through the mid span support and a slat to allow the slat to pivot to position the inclined railing panel and a nonperpendicular angle to follow stairs or a sloped terrain.

Advantages of the disclosed embodiments of the length adjustable railing panels with removable upright end rails include a railing panel that can be easily cut to fit a shorter post spacing than common six or eight foot post spacing. The railing panel can be easily cut down and reassembled without requiring welding or customization for the railing panel to fit a particular post spacing. The advantages extend to level railing and inclined railing with the reassembled panel being adjustable through a range of rake angles.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION

Figure 1:
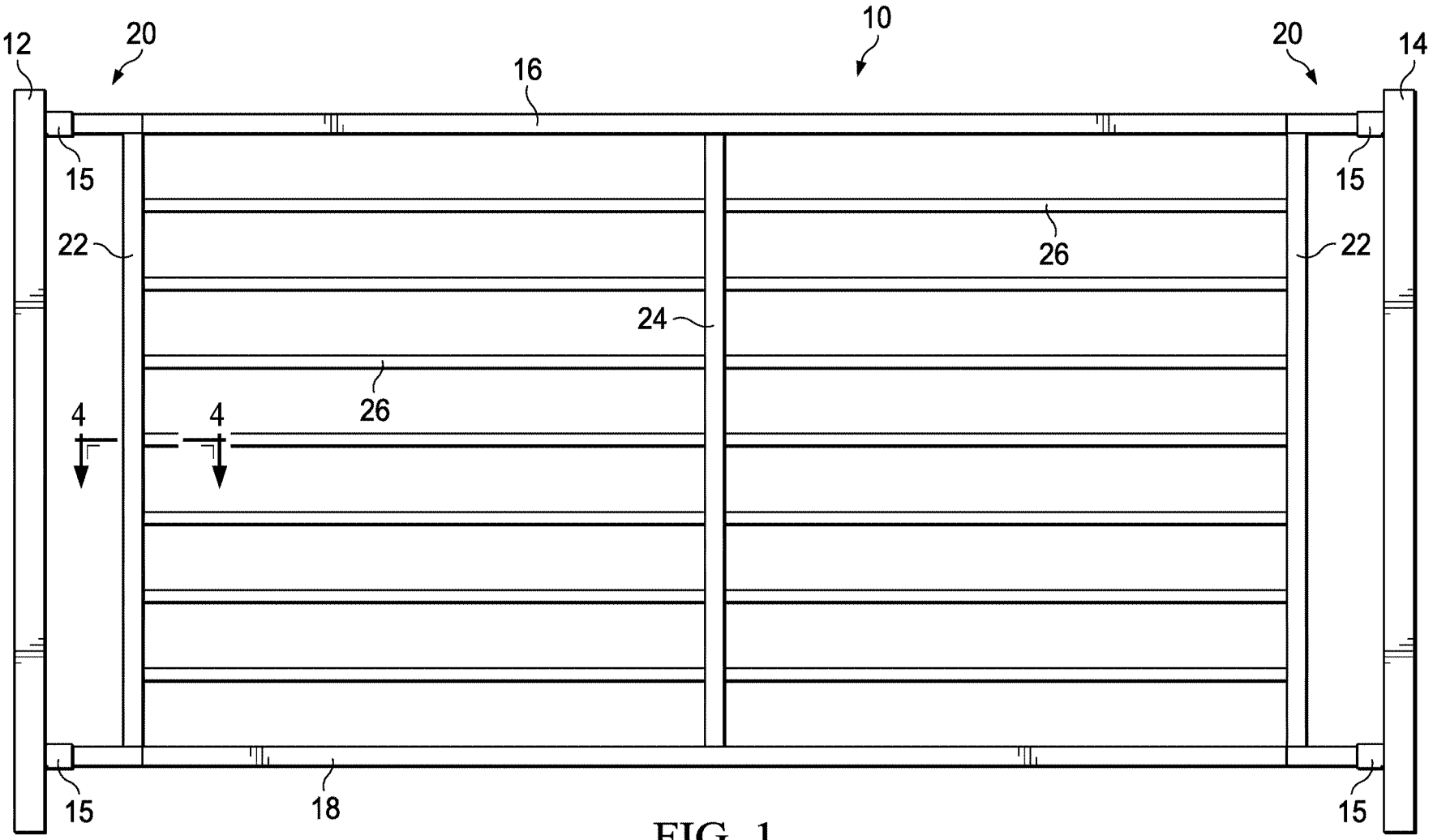
FIG. 1 is a front, elevation view of an embodiment of a length adjustable railing panel with removable vertical rails according to the teachings of the present disclosure.

Reference is now made to FIG. 1, which shows a railing panel 10 supported by a first post 12 and a second post 14.

The support post 12 may be spaced apart from the support post 14 approximately 6 feet. Each support post 12, 14 may be secured to a structure, such as a deck frame for an outdoor deck. The support post 12 includes a pair of brackets 15 that receive ends of a top rail 16 and a bottom rail 18 respectively. Similarly, the support post 14 includes brackets 15 that receive opposite ends of the top rail 16 and the bottom rail 18. The brackets 15 may be secured to a face of the posts 12, 14 using any suitable joining process, such as welding or fasteners, such as metal screws. The railing panel 10 may be preassembled at a factory and may have a length of approximately 6 feet measured from the ends of the top and bottom horizontal rails 16, 18 to the opposite ends of the top and bottom horizontal rails 16, 18. The length of the panel corresponds to an approximate distance between the first post 12 and the second post 14. The length of the railing panel 10 may be slightly less than six feet, but still have a sufficient length to fit between the first post 12 and the second post 14 and be received in the brackets 15.

The railing panel 10 includes a pair of length adapters 20 disposed proximate each end of the railing panel 10. According to certain embodiments, the railing panel 10 may also include a mid-span support rail 24. The infill of the railing panel 10 includes a plurality of spaced apart slats 26. Each of the slats 26 extends longitudinally from an upright end rail 22 of a length adapter 20 at one end to an upright end rail 22 of a length adapter 20 at the opposite end.

Figure 2:
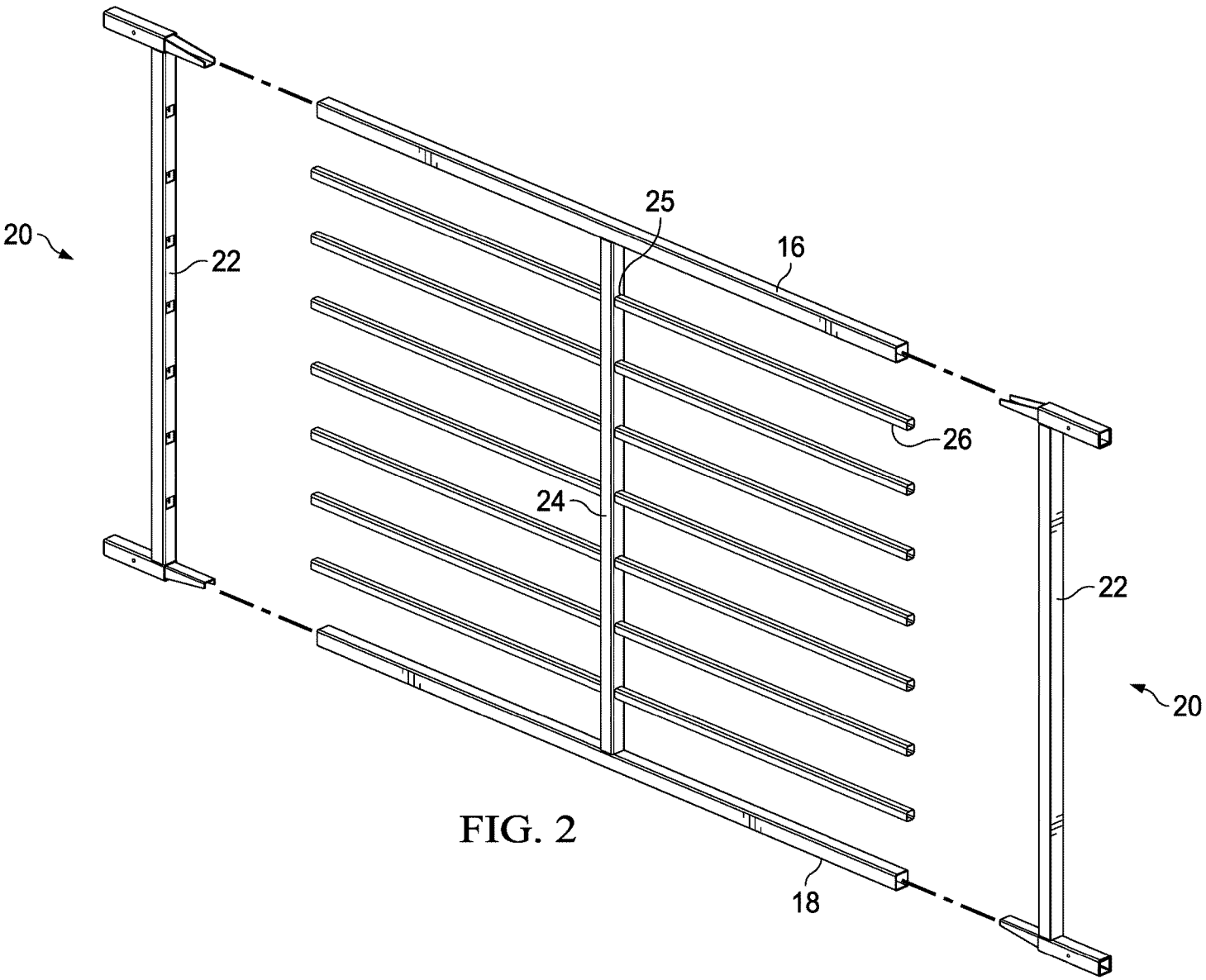
FIG. 2 is a partially exploded, perspective view of a cut down length adjustable railing panel.

The mid-span support rail 24 includes a plurality of through holes 25 through which each slat 26 extends (see FIG. 2). The illustrated embodiment includes seven slats 26, but any suitable number of slats for the infill of the railing panel 10 is contemplated by this disclosure. The slats 26 may be formed of any suitable material, for example aluminum or steel. The slats 26 may have any suitable cross-section, for example square, circular, arcuate, triangular, and the like. The illustrated slats 26 have a square-shaped cross section consistent with the cross-sectional shapes of the other components of the railing panel 10.

The slats may be a generally hollow structure formed with sheet metal. According to one embodiment, the slats may have a dimension in a range of 0.25-1.0 inches square, for example 0.6 inches square. The edges of the slats may be rounded. The sheet metal may have a thickness in a range of approximately 0.02-0.06 inches, for example 0.040 inches. The slats 26 may be formed from aluminum or other material that may be extruded or otherwise fabricated to form an elongated bar with a square-shaped cross-section. According to one embodiment, the slats 26 are roll formed and provided with a seam that runs the length of the slat 26. According to an embodiment, the slats 26 are fabricated from galvanized steel. According to an alternate embodiment, the slats 26 may be formed by extruding aluminum.

Reference is now made to FIG. 2, which illustrates a partially exploded view of the railing panel 10 shown in FIG. 1 cut to a length to be received and supported by support posts that are spaced approximately five feet apart. The preassembled railing panel 10 may have been manufactured and supplied to a job site with a length of approximately six feet. Other preassembled lengths are contemplated by this disclosure, for example the railing panel 10 may have a length of eight feet. An installer temporarily removes each of the length adapters 20 and cuts the infill of the railing panel to allow the length adapters to be reassembled and the railing panel to fit between the five foot post spacing.

According to embodiments of the present disclosure, the open space between the support post and the upright end rail 22 of the length adapter 20 is maintained on each end of the railing panel 10. This spacing may be in a range of 2-8 inches, for example approximately four inches.

The length adapters 20 may be provided as part of the assembled rail panel 10, as shown in FIG. 1. Alternatively, the upright end rails 22 may be welded to the infill, and a pair of length adapters may be provided separately. According to this welded infill embodiment, to cut-down the rail panel 10 to fit the five foot space between the posts, approximately six inches is measured from the upright end rail 22 toward the mid-span support rail 24 and the top rail 16 and the bottom rail 18 is cut. The slats 26 are also cut down approximately six inches on a side. However, 0.25 to 0.5 inches of the slats 26 may extend beyond the cut-down top rail 16 and bottom rail 18 to allow a portion of the slats 26 to be received by the upright end rail 22 of the length adapter 20, as described in more detail below. Six inches is measured from the upright end rail 22 on each end of the railing panel 10 toward the mid-span support 24, and the top rail 16 and the bottom rail 18 are cut. The slats 26 are also similarly measured and cut, but a length of 0.25 to 0.5 inches extends beyond the cut-down length of the top rail 16 and the bottom rail 18 to allow a portion of the slats to be received by the upright end rail 22 of the length adapter 20.

The length adapters 20 are shown exploded from the cut down railing panel 10. Each length adapter 20 is configured to be secured to the cut down railing panel 10 and to be secured to one of the support posts. The length adapters 20 accommodate a cut length of the railing panel 10 and maintain the spacing between the posts 12, 14 and the upright end rails 22 of the length adapter 20.

Figure 3:
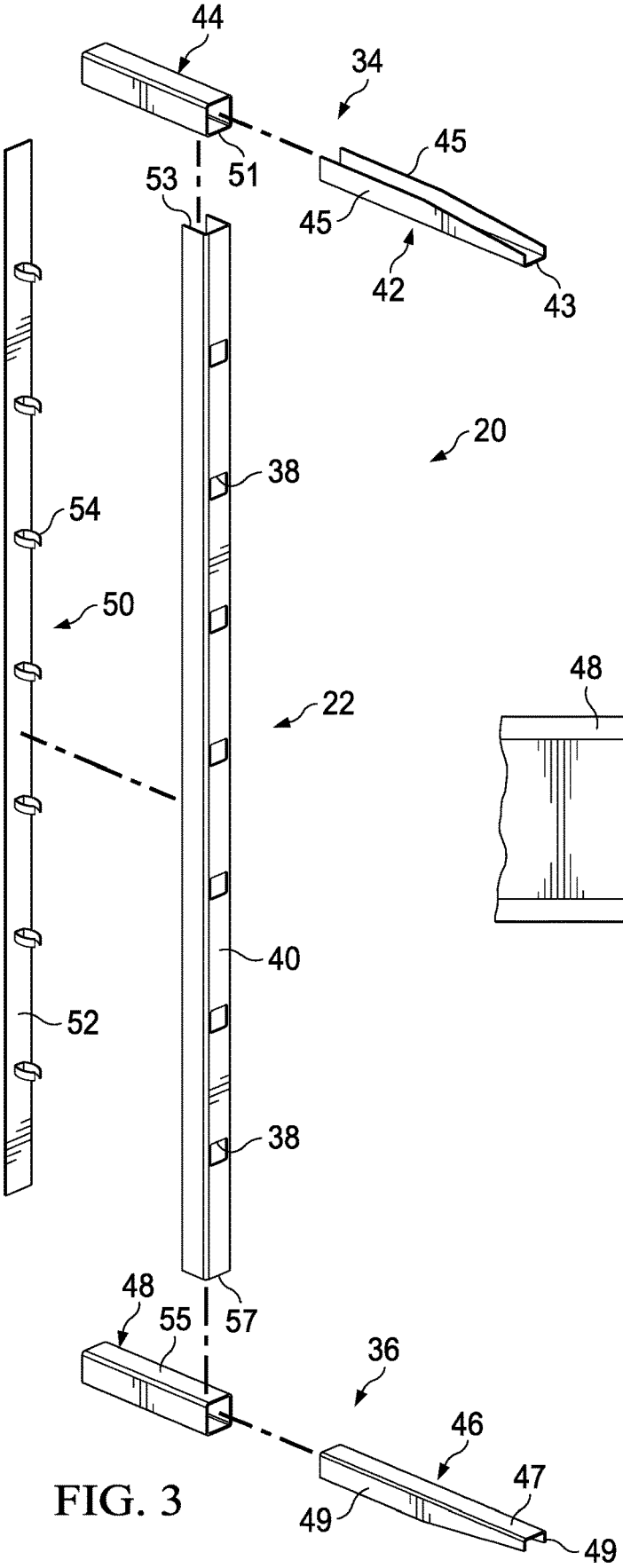
FIG. 3 is an exploded, perspective view of a length adapter of the rail panel of FIG. 1.

Reference is made to FIG. 3, which is an exploded view of the length adapter 20. The length adapter 20 includes an upright end rail 22, a top rail adapter 34, and a bottom rail adapter 36. The upright end rail 22 may be a generally U-shaped member formed of any suitable material, such as aluminum or steel. According to one embodiment, the upright end rail 22 is formed of sheet metal, for example galvanized steel. According to an alternate embodiment, the upright end rail 22 may be formed of extruded aluminum. According to one embodiment, the upright end rail 22 may have a dimension in a range of 0.5-1.5 inches square, for example 1.0 inches square. The edges of the upright end rail 22 may be rounded. The sheet metal may have a thickness in a range of approximately 0.04-0.10 inches, for example 0.060 inches. According to one embodiment, the upright end rail 22 is roll formed into the U-shaped member. Alternatively, the upright end rail 22 may have a generally square cross section provided with a seam that runs the length of the upright end rail 22.

The upright end rail 22 may be punched to form a plurality of apertures 38 through a front face 40. The apertures 38 are sized and shaped to receive an end portion of a slat 26 therein.

The top rail adapter 34 includes an insertable portion 42 and a top rail extender 44. The insertable portion may be a U-shaped member formed of any suitable material, such as aluminum or steel. The top rail extender 44 has a square shaped cross-section sized to correspond to the size and shape of the top rail 16. The insertable portion 42 and the top rail extender 44 may each be sized to allow the insertable portion 42 to be received by the top rail extender 44 and secured therein using any suitable joining technique, such as welding. Upon being inserted into the top rail extender 44, the insertable portion 42 extends a predetermined distance beyond the top rail extender 44, as shown in FIG. 2. The combined top rail adapter 34 may be welded, or otherwise secured to the upright end rail 22. According to an embodiment, a bottom face of the top rail extender 44 may be welded to an upper end of the upright end rail 22.

The bottom rail adapter 36 includes an insertable portion 46 and a bottom rail extender 48. The insertable portion 46 may be a U-shaped member formed of any suitable material, such as aluminum or steel. The bottom rail extender 48 has a square shaped cross-section sized to correspond to the size and shape of the bottom rail 18. The insertable portion 46 and the bottom rail extender 48 may each be sized to allow the insertable portion 46 to be received by the bottom rail extender 48 and secured therein using any suitable joining technique, such as welding. Upon being inserted into the bottom rail extender 48, the insertable portion 46 extends a predetermined distance beyond the bottom rail extender 48, as shown in FIG. 2. The combined bottom rail adapter 36 may be welded, or otherwise secured to the upright end rail 22. According to an embodiment, a bottom face of the bottom rail extender 48 may be welded to a lower end of the upright end rail 22.

A cover 50 may include a generally flat bar 52 that is welded or otherwise secured to the open face of the upright end rail 22. A plurality of biased inserts 54, which may also be referred to as clips, are welded or otherwise secured to be disposed equally spaced apart along the length of the cover 50. When the cover 50 is welded to the upright end rail 22, the biased inserts 54 align with a respective aperture 38 in the upright end rail 22.

As discussed above, the assembled and welded length adapter 20 may be provided separately from the rail panel 10 to allow the installer to use when the spacing between posts does not fit the length of the manufactured and preassembled rail panel 10.

The length adapter 20 is assembled to an end of the cut down rail panel 10. The insertable portion 46 is inserted into an end of the bottom rail 18, and the insertable portion 42 is inserted into and end of the top rail 16. Alternatively, the top rail 16 may be inserted into the insertable portion 42, and the bottom rail 18 may be inserted into the insertable portion 46. According to an embodiment, a fastener may be received through a wall of the top rail 16 and into a wall of the insertable portion 42, preferably the bottom walls to obscure view of the fastener. However, the insertable portion 42 may simply be inserted into and friction fit into the top rail 16. Similarly, the insertable portion 46 may be inserted and friction fit into an end of the bottom rail 18, and may optionally be secured with a fastener.

The top and bottom rails 16, 18 and the top and bottom rail extenders 44, 48 may be generally hollow structures with a square cross section and may be formed of any suitable material, such as aluminum or steel. According to one embodiment, the top and bottom rails 16, 18 and the top and bottom rail extenders 44, 48 are formed of sheet metal, for example galvanized steel. According to an alternate embodiment, they may be formed of extruded aluminum. According to one embodiment, top and bottom rails 16, 18 and the top and bottom rail extenders 44, 48 may have a dimension in a range of 0.5-1.5 inches square, for example 1.0 inches square. The edges of top and bottom rails 16, 18 and the top and bottom rail extenders 44, 48 may be rounded. The sheet metal may have a thickness in a range of approximately 0.04-0.10 inches, for example 0.060 inches. According to one embodiment, top and bottom rails 16, 18 and the top and bottom rail extenders 44, 48 are roll formed into a member with a square cross section with a welded seam that runs their respective length. Alternatively, top and bottom rails 16, 18 and the top and bottom rail extenders 44, 48 may have a U-shaped cross section.

According to an embodiment, the flat bar 52 of the cover 50 may be a sheet of galvanized steel with a thickness in a range of in a range of approximately 0.04-0.10 inches, for example 0.060 inches.

Figure 4:
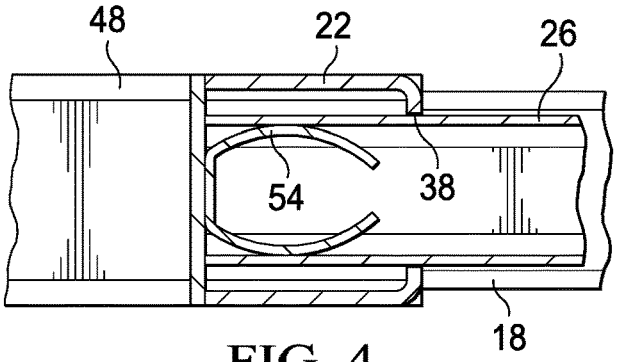
FIG. 4 is a detail, perspective view of the junction of a slat with a biased insert of the length adapter of FIG. 3.

FIG. 4 is a detailed, perspective view of the junction of a slat 26 with the upright end rail 22. An end portion of each of the slats 26 is received in a respective aperture 38 in the upright end rail 22. The biased insert 54 is received by the slat 26. The walls of the slats 26 direct the arms of the biased insert inward toward each other and elastically displaces the arms of the insert away from their relaxed position. The biased insert 54 is biased to return to its relaxed position, which imparts a force on walls of the slat 26 to hold the slat 26 against the wall of the aperture 38. In this manner, the slat 26 may be secured against rattling within the aperture 38.

A second length adapter 20 is similarly assembled to the opposite side of the cut-down rail panel 10. The rail panel 10 assembled with a length adapter 20 on each side is coupled to the support posts, similarly to as shown in FIG. 1. According to one embodiment, the railing panel 10 may be received into cup-type brackets that have been secured, using fasteners or welding, to the posts 12, 14. After setting the railing panel 10 including the length adapters 20 into the cup portion of the brackets and using fasteners to secure the rail extenders 44, 48 to the cups, a cap may be received over the cup and the end of the rail extenders 44, 48. The cap hides the fastener hardware used to secure the rail extenders 44, 48 to the brackets 15. A suitable bracket is described in U.S. Pat. No. 10,590,656 to Burt et al., entitled, "Bracket for Supporting Attachment of the End of a Railing Member to a Vertical Member," filed on Oct. 17, 2019, and claiming priority to a provisional patent application filed on Jan. 10, 2012, which is hereby incorporated by reference.

Additional fasteners may be unnecessary in assembling the rail panel 10 to the length adapters 20 because positioning the railing panel 10 assembled with the length adapters 20 between and supported by two posts 12, 14 adequately holds the assembly together. Thus, the length of the railing panel 10 may be cut down to any suitable length and fitted with the length adapters 20 to allow customization of a preassembled railing panel without welding or other joining techniques.

Figure 5A:
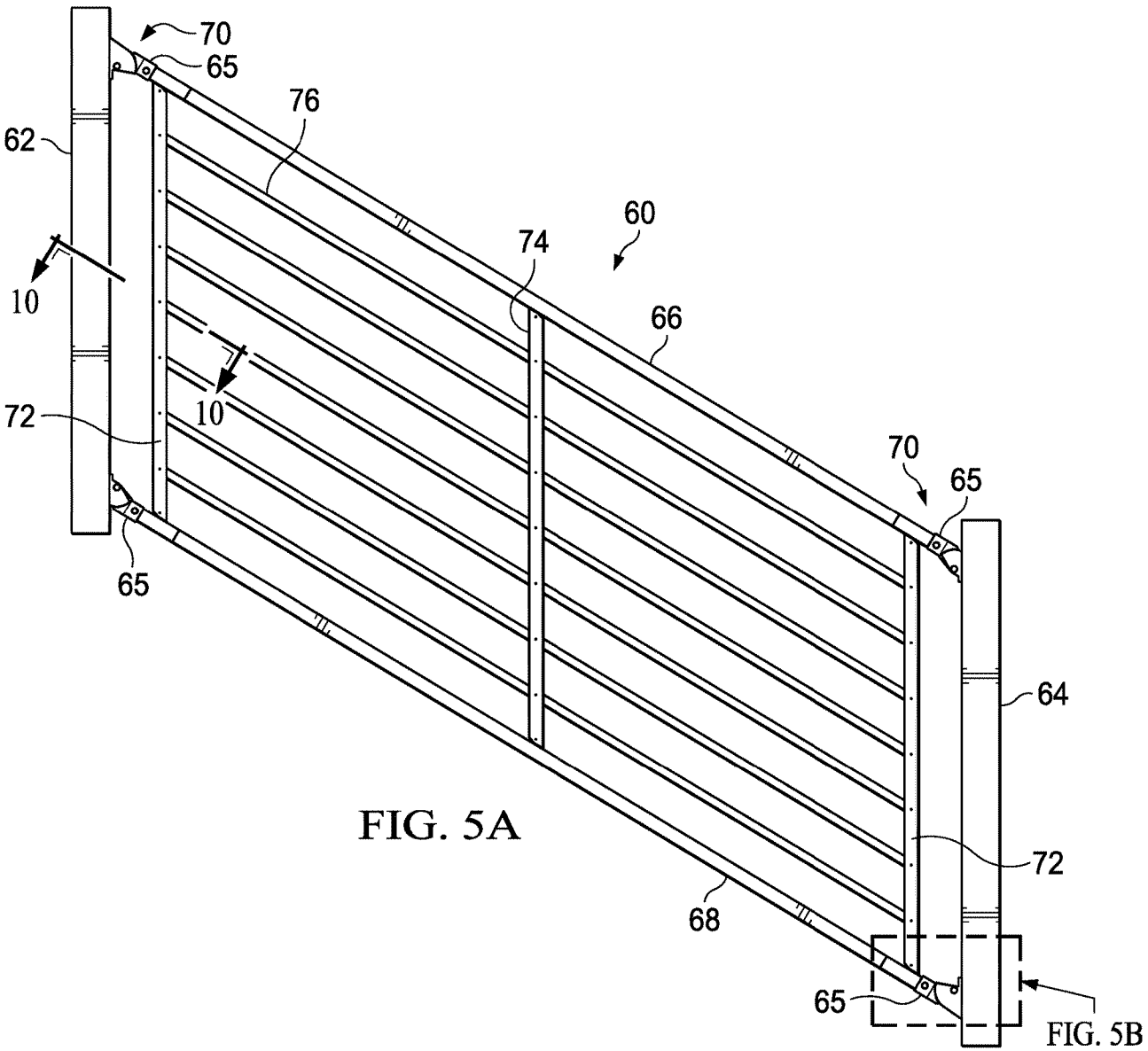
FIG. 5A is a front, elevation view of an inclined embodiment of a length adjustable rail panel with removable vertical rails according to the teachings of the present disclosure.
Figure 5B:
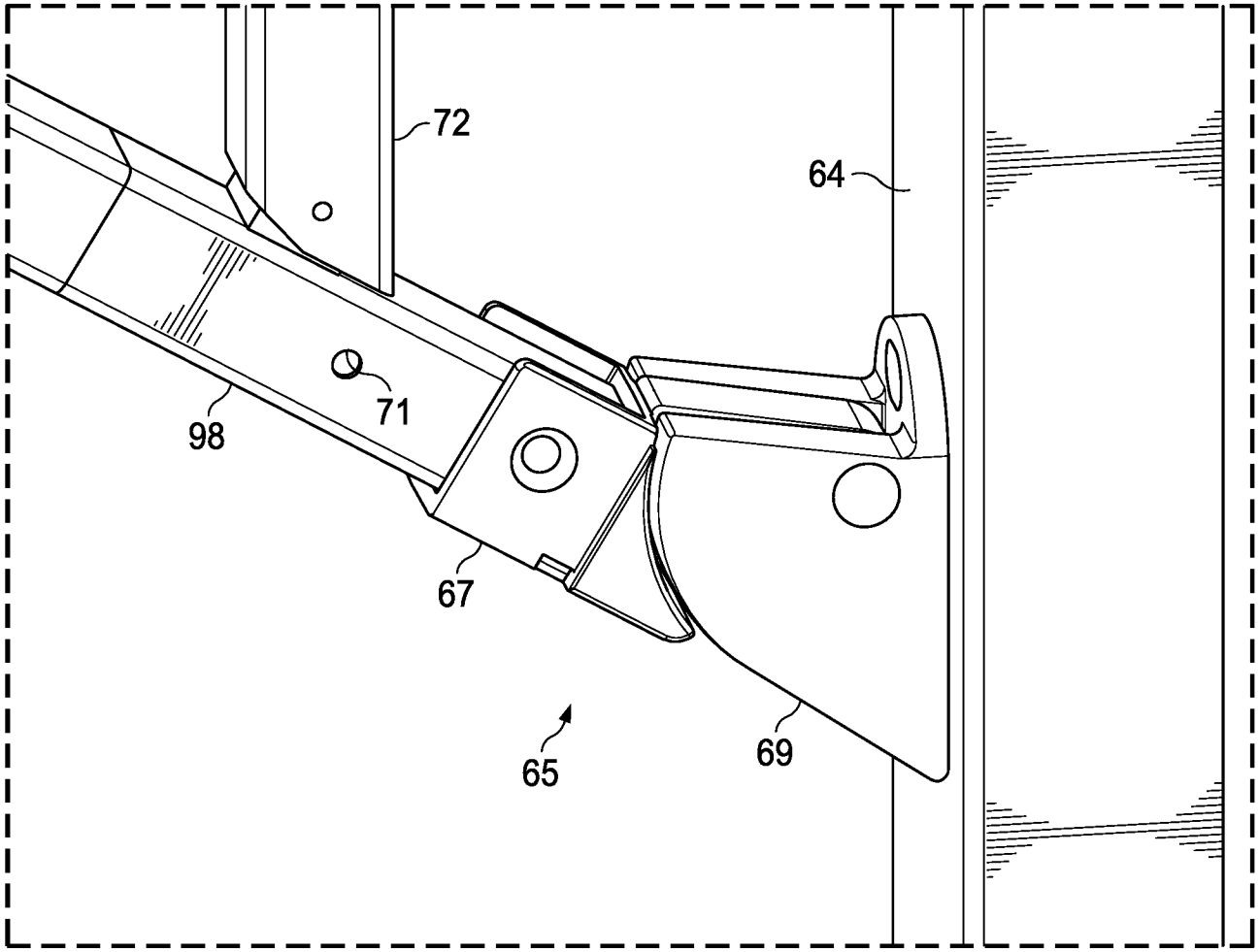
FIG. 5B is a detail view of a portion of the embodiment shown in FIG. 5A.

Reference is made to FIG. 5, which shows a side, elevation view of an embodiment of the present disclosure. An incline railing panel 60 includes may be used for stairs or sloped terrain. The inclined railing panel 60 includes a top rail 66 and a bottom rail 68 that are positioned generally parallel to the slope of the stairs or the sloped terrain. The incline railing panel 60 may be cut to fit post spacing that is less than the length of the manufactured incline railing panel 60. Each of a pair of incline length adapters 70 is disposed at an end of the incline railing panel 60.

An upper support post 62 supports an upper end of the incline railing panel 60, and a lower support post 64 supports a lower end of the incline railing panel 60. According to an embodiment, a pair of pivotable brackets 65 is secured to a face of the upper support post 62, and a second pair of pivotable brackets 65 is secured to the lower support post 64. The brackets 65 hold the incline length adapters 70, similarly to as described above with respect to FIGS. 1-4. Suitable pivotable brackets are disclosed in U.S. Pat. No. 10,590,656.

According to an embodiment the incline railing panel 60 is assembled to allow it to pivot through a range of rake (or rack) angles. For example, the pivotable connections of the components of the incline railing panel 60, as described in more detail below, facilitate a rake angle in a range of zero to 45° with respect to horizontal. According to one embodiment, the railing panel is adjustable in a range of 20° thru 50° with respect to horizontal, for example a 30°-40° range with respect to horizontal is shown in the illustrated embodiment. A plurality of slats 76 creates the infill of the incline railing panel 60. The slats 76 are pivotably coupled to a mid-span support rail 74. More specifically, a plurality of through holes 75 are formed through the mid-span support rail 74 and are sized and shaped to receive a respective slat 76 and to allow clearance for the slat 76 to pivot through the rake angle. A pivot pin is received through the mid-span support rail 74 and through a corresponding through hole in the slat 76. The pivot pin may be welded or otherwise secured to the mid-span support rail 74. Each slat 76 is pivotable about its respective pivot pin.

As discussed above with respect to FIGS. 1-4, the slats 26, the top rail 66, the bottom rail 68, and the mid-span support rail 74 may have any suitable cross-sectional shape including square, triangular, circular, arcuate, and the like. The illustrated embodiment includes rails with square-shaped cross-sections. Each of the rails may be roll formed and include a welded seam along their length. Alternatively, the rails may be extruded aluminum. The material of the rails may be any suitable material, such as aluminum or steel. The dimensions of the railing components of the inclined railing panel 60 may be the same as discussed above with respect to FIGS. 1-4.

Figure 6:
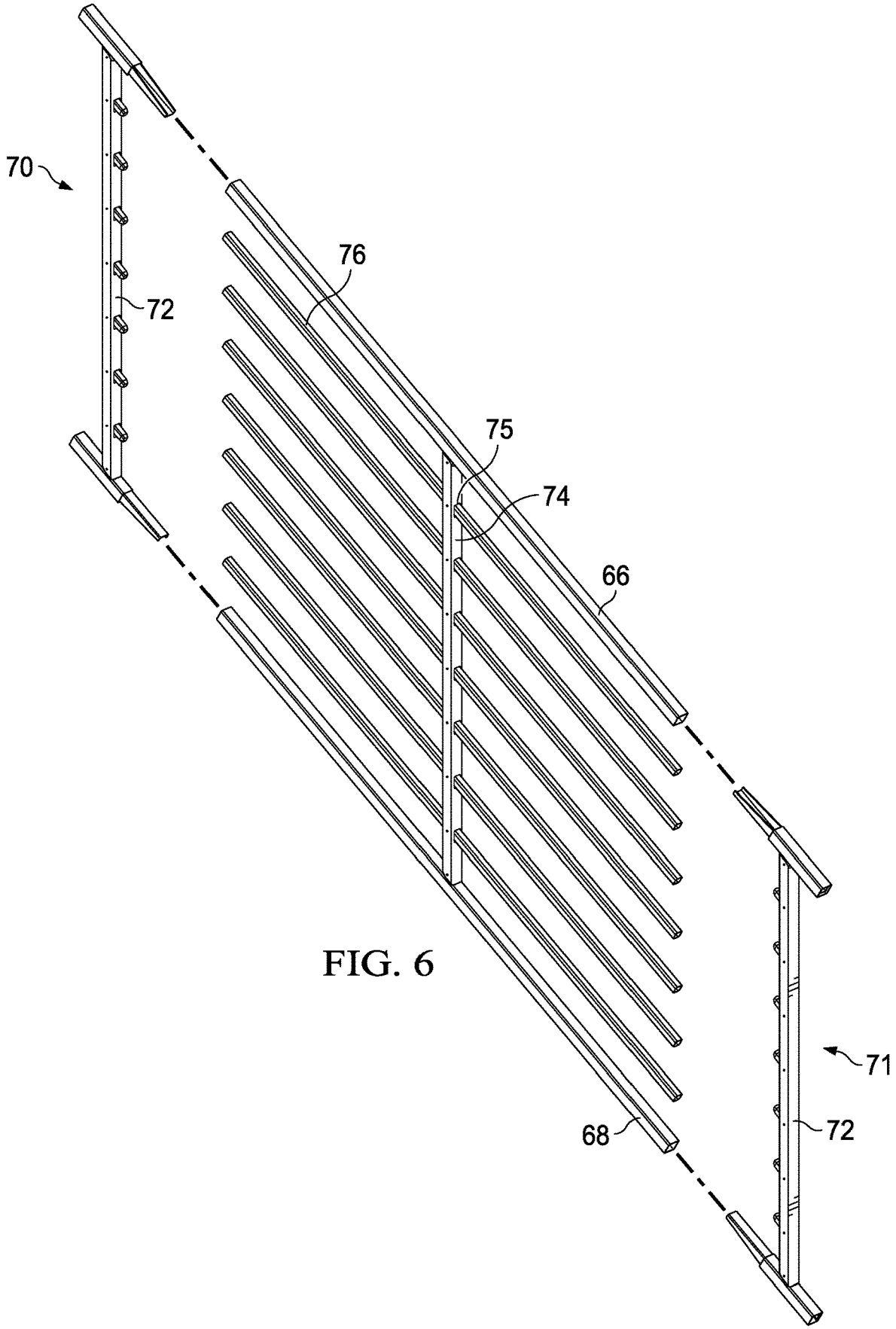
FIG. 6 is a partially exploded perspective view of a cut down inclined length adjustable railing panel according to the teachings of the present disclosure.

Reference is made to FIG. 6, which shows a partially exploded, perspective view of the incline railing panel 60 with a pair of incline length adapters 70. The infill of the incline railing panel 60 may be cut down to fit between upper and lower support posts that are spaced apart approximately five feet diagonally. That is, the top rail 66 and the bottom rail 68 have been cut down approximately six inches from their respective ends toward the mid-span support rail 74. The slats 76 may be cut to extend 0.25 to 0.5 inches beyond the ends of the top and bottom rails 66, 68 to allow the ends of the slats 76 to be received by an aperture formed in a face of an upright end rail of the incline length adapter 70, as described in more detail below.

Figure 7:
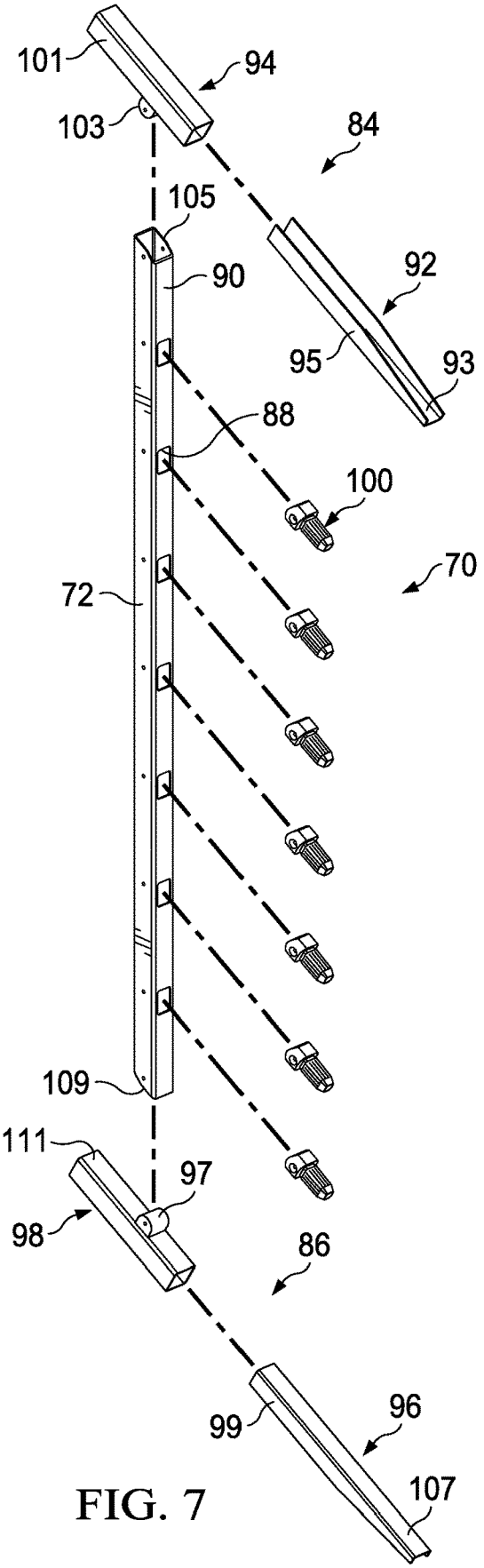
FIG. 7 is an exploded, perspective view of a length adapter for an inclined length adjustable railing panel.

FIG. 7 is an exploded, perspective view of an incline length adapter according to the teachings of the present disclosure. The length adapter 70 is similar to the length adapter shown and described with respect to FIGS. 1-4 with certain features to allow the joined components to pivot through the rake angle. The incline length adapter 70 includes an upright end rail 72, a top rail adapter 84, and a bottom rail adapter 86.

The upright end rail 72 may be formed of any suitable material, such as aluminum or steel, and may have any suitable cross-sectional shape, for example square. A plurality of equally spaced apart apertures 88 are formed in a front face 90 of the upright end rail 72. The apertures are sized and shaped to receive an end of a respective slat 76 and provide clearance for the slat 76 to pivot through the rake angle. In one embodiment, the apertures 88 are rectangular and have a long dimension to short dimension ration of approximately 1.5 to 1. For example, the apertures 88 may have a short dimension of approximately 0.6 inches and a long dimension of approximately 0.9 inches.

The top rail adapter 84 includes an insertable portion 92 and a top rail extender 94. The insertable portion may be a U-shaped member formed of any suitable material, such as aluminum or steel. The top rail extender 86 has a square shaped cross-section sized to correspond to the size and shape of the top rail 66. The insertable portion 92 and the top rail extender 94 may each be sized to allow the insertable portion 92 to be received by the top rail extender 94 and secured therein using any suitable joining technique, such as welding. Upon being inserted into the top rail extender 94, the insertable portion 92 extends a predetermined distance beyond the top rail extender 94, as shown in FIG. 6.

According to an embodiment, a bottom face of the top rail extender 94 may be welded to an upper hinge block 93. The upper hinge block 93 may be received and pivotably attached to the upright end rail 72 using a pivot pin. According to an embodiment, the upper end of the upright end rail 72 may include an angled upper end 95. The non-perpendicular angle of the upper end corresponds to a rake angle of the incline railing panel 60 and also provides clearance for the top rail adapter 84 to pivot through the rake angle.

The bottom rail adapter 86 includes an insertable portion 96 and a bottom rail extender 98. The insertable portion 96 may be a U-shaped member formed of any suitable material, such as aluminum or steel. The bottom rail extender 98 has a square shaped cross-section sized to correspond to the size and shape of the bottom rail 68. The insertable portion 96 and the bottom rail extender 98 may each be sized to allow the insertable portion 96 to be received by the bottom rail extender 98 and secured therein using any suitable joining technique, such as welding. Upon being inserted into the bottom rail extender 98, the insertable portion 96 extends a predetermined distance beyond the bottom rail extender 98, as shown in FIG. 6.

According to an embodiment, a bottom face of the bottom rail extender 98 may be welded to a lower hinge block 97. The lower hinge block 97 may be received and pivotably attached to the upright end rail 72 using a pivot pin. According to an embodiment, the lower end of the upright end rail 72 may include an angled lower end 99. The non-perpendicular angle of the angled lower end 99 corresponds to a rake angle of the incline railing panel 60 and also provides clearance for the bottom rail adapter 86 to pivot through the rake angle.

A pivotable insert 100 is received in each of the apertures 88 and pivotably coupled to the upright end rail 72 with a hinge pin 102 that is receive through holes 104 in the side walls 106 of the upright end rail 72.

Reference is made to FIG. 8, which shows a detail, exploded, perspective view of the junction of the pivotable insert 100. The pivotable insert 100 includes a base 108 and a projection portion 110. The pivotable insert 100 may be case from Zinc Aluminum Alloy. Other materials and fabrication for the pivotable insert 100 are contemplated by this disclosure. The base 108 is received in the aperture 88 in the front face 90 of the upright end member 72 and pivotably secured within the upright end member 72 with the hinge pin 102. The hinge pin 102 is received through a hinge hole 112 in the base 108. According to an embodiment, the hinge hole 112 may be countersunk.

Figure 8A:
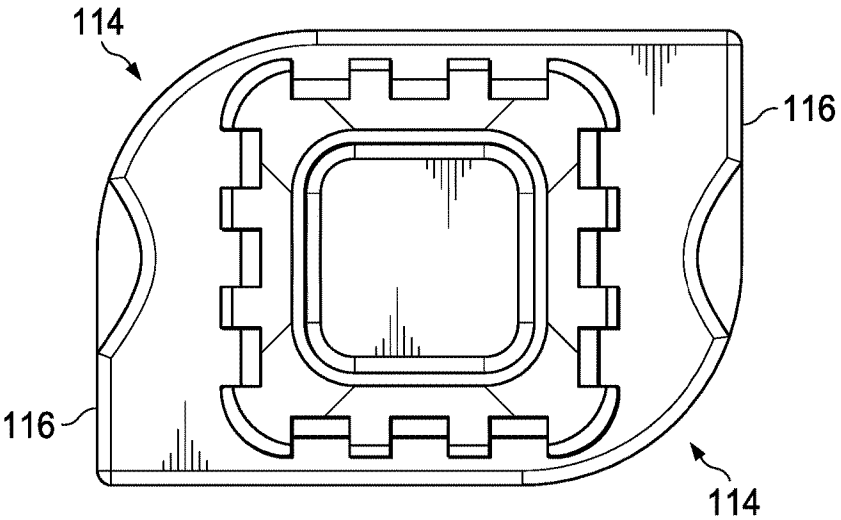
FIGS. 8A and 8B are front and side views respectively of a pivotable insert of the length adapter of FIG. 7.
Figure 8B:
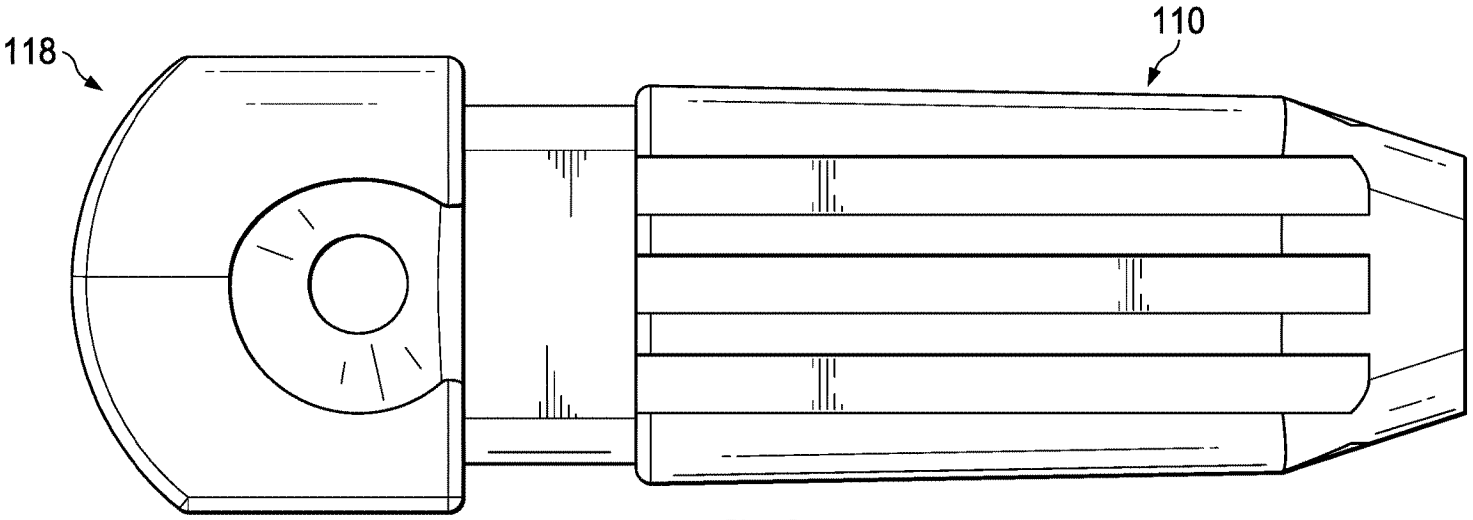

FIGS. 8A and 8B are a front view and a side view of the pivotable insert 100. The pivotable insert 100 includes diagonally opposed arcuate or rounded surfaces 114.

Figure 9A:
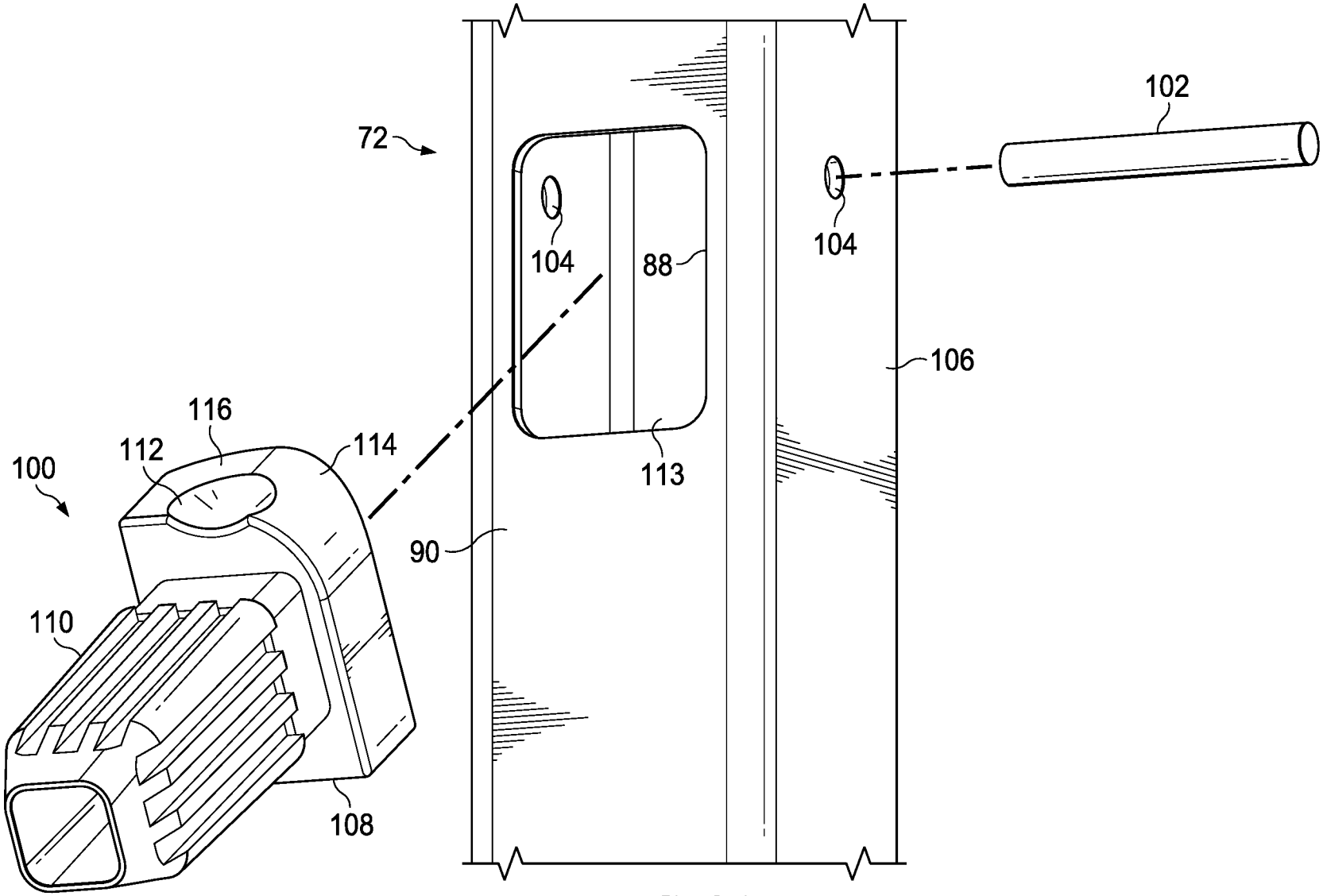
FIGS. 9A and 9B are perspective view of the assembly of the pivotable insert with an upright end rail of the inclined length adapter shown in FIG. 7.
Figure 9B:
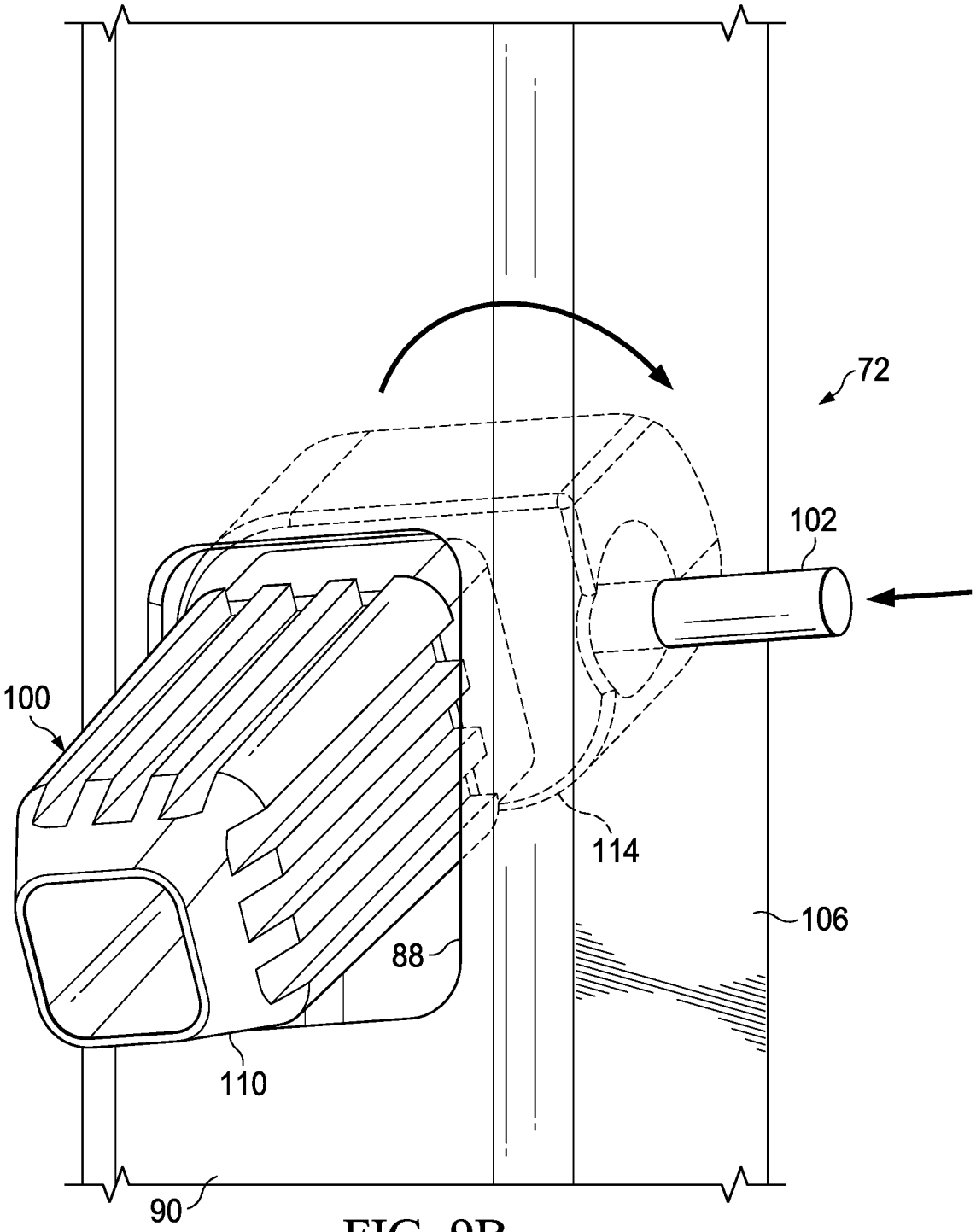

FIGS. 9A and 9B are perspective views showing steps of inserting the pivotable insert 100 into the upright end rail 72. The arcuate surfaces 114 provide clearance to allow the pivotable insert 100 to be inserted into upright end member 72 through the aperture 88 and rotated approximately a quarter-turn to position opposed flat surfaces 116 of the base to abut the inner surfaces of the side walls 106 of the upright end rail 72.

Figure 10:
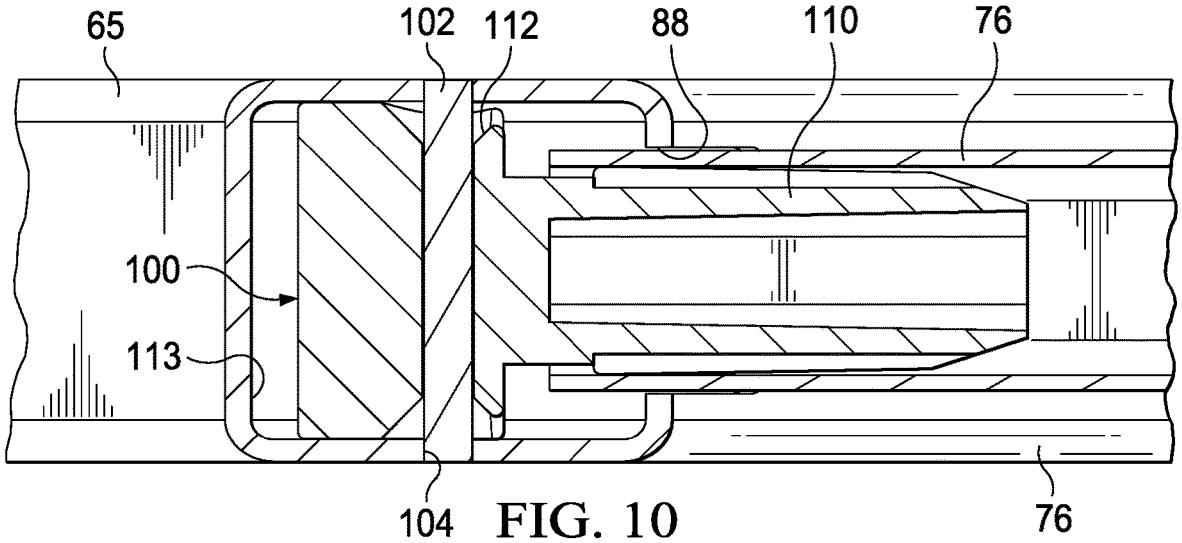
FIG. 10 is a perspective view of a junction of a slat with the pivotable insert shown in FIGS. 7-9B.

FIG. 10 is a detailed, perspective view of the junction of a slat 76 and the pivotable insert 100. The pivotable insert 100 receives the hinge pin 102 through the hinge hole 112 in the base 108. The hinge pin may be welded to the upright end member 72 and subsequently grounded down. Powder coating of the incline railing panel 60 including the ground pivot pins and hinge pins 102 may hide the pins from view.

A rear surface 118 of the base 108 is rounded to provide clearance from a rear wall 113 of the upright end member 72 to allow the pivotable insert 100 to pivot through the rake angle.

The projection portion 110 of the pivotable is sized and shaped to be received by an end of a slat 76. The projection may be tapered to facilitate insertion into the slat 76. The insert may be friction fit into the slat 76. Additional fasteners may be omitted due to the friction fit of the projection in the slat 76.

Similar to the discussion with respect to FIGS. 1-4, the incline railing panel 60 including the incline length adapters 70 that are assembled to the infill (i.e. the top rail 66, the bottom rail 68, and the slats 76) is received in the brackets 65 secured to the upper support post 62 and the lower support post 64.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

The invention claimed is:

1. A railing panel, comprising:

a top rail comprising a hollow tubular structure and extending longitudinally in a first direction from a first open end to a second open end disposed opposite the first open end;

a bottom rail comprising a hollow tubular structure and extending longitudinally in a second direction from a first open end to a second open end disposed opposite the first open end of the bottom rail, the bottom rail disposed spaced apart from the top rail;

a plurality of slats disposed between and running parallel to the top rail and the bottom rail, each one of the plurality of slats being a hollow rigid body and running from a first length adapter to a second length adapter;

a midspan support rail defining a plurality of through holes, each through hole receiving a slat therethrough; and each of the first and second length adapters, comprising:

an upright end rail defining a plurality of apertures, an upper insertable portion disposed at a first end of the upright end rail and extending in the first direction, the upper insertable portion sized and shaped to be inserted into the first open end of the top rail in the first direction, a lower insertable portion disposed at a second end of the upright end rail opposite the first end and extending in the second direction, the lower insertable portion being sized and shaped to be inserted into the first open end of the bottom rail in the second direction, and a plurality of inserts coupled to the upright end rail, each insert disposed proximate a respective aperture of the plurality of apertures, each insert configured to be received by a respective slat;

wherein the upper insertable portion is received by the first open end of the top rail and further comprises at least one fastener received through the top rail and the upper insertable portion.

2. The railing panel of claim 1 wherein each insert is biased to exert a force on an internal surface of the respective slat.

3. The railing panel of claim 1 wherein each of the plurality of apertures is sized and shaped to receive an end of each of the plurality of slats and each insert is friction fit within the end of the respective slat.

4. The railing panel of claim 3 wherein each insert is pivotable through a rake angle.

5. The railing panel of claim 4 wherein the rake angle is in a range of 0°-45° with respect to horizontal.

6. The railing panel of claim 5 wherein the rake angle is in a range of 30°-40° with respect to horizontal.

7. The railing panel of claim 1 wherein the upper insertable portion is configured to be received in friction fit within the first open end of the top rail and the lower insertable portion is configured to be received in friction fit within the first open end of the bottom rail.

8. The railing panel of claim 1 further comprising a pair of posts, the first length adapter being configured to be coupled to one of the pair of posts.

9. The railing panel of claim 8 wherein the first length adapter is configured to be received by a bracket, the bracket being secured to one of the pair of posts.

10. The railing panel of claim 1 wherein each of the top rail, bottom rail, and each of the slats run horizontally.

11. The railing panel of claim 1 wherein each of the top rail, the bottom rail, and each of the slats run at a nonperpendicular angle with respect to horizontal.

12. The railing panel of claim 1 wherein each one of the apertures has a long dimension sized to accommodate the respective slat being disposed at a nonperpendicular angle.

13. The railing panel of claim 1 wherein the hollow tubular structure of the top and bottom rails each comprises a four wall structure.

14. A length adapter system for a railing panel, comprising:

a first length adapter and a second length adapter, each comprising:

an upright end rail defining a plurality of apertures;

an upper insertable portion extending longitudinally from an end of a top rail extender and parallel to the top rail extender, the top rail extender disposed at a first end of the upright end rail;

a lower insertable portion extending longitudinally from an end of a bottom rail extender and parallel to the bottom rail extender, the bottom rail extender disposed at a second end of the upright end rail opposite the first end; and a plurality of inserts welded to the upright end rail, each insert disposed proximate a respective aperture of the plurality of apertures, each insert configured to be received by a slat, the slat being a hollow rigid body with at least one open end and extending from the first length adapter to the second length adapter;

wherein for each of the first and second length adapters each of the plurality of apertures is sized and shaped to receive a slat and each insert is biased to exert a force on an internal surface of the slat, wherein each biased insert is welded to an internal surface of the upright end rail.

15. The length adapter system of claim 14 wherein for each of the first and second length adapters, each insert of the plurality of inserts is an insert assembly comprising and pivotable about a hinge pin welded to the upright end rail.

16. The length adapter system of claim 15 wherein for each of the first and second length adapters each insert of the plurality of inserts is configured to be received through the aperture and rotated such that a base of the insert impinges on internal surfaces of the upright end rail.

17. A railing panel, comprising:

a top rail comprising a hollow tubular structure and extending longitudinally in a first direction from a first open end to a second open end disposed opposite the first open end;

a bottom rail comprising a hollow tubular structure and extending longitudinally in a second direction from a first open end to a second open end opposite the first open end of the bottom rail, the bottom rail disposed spaced apart from the top rail;

a plurality of slats disposed between and running from a first length adapter to a second length adapter and running parallel to the top rail and the bottom rail, each of the plurality of slats being a hollow rigid body; and each of the first length adapter and the second length adapter, comprising:

an upright end rail defining a plurality of apertures, a top rail adapter disposed at a first end of the upright end rail, an upper insertable portion of the top rail adapter extending in the first direction and being received by the first open end of the top rail, a bottom rail adapter disposed at a second end of the upright end rail opposite the first end, a lower insertable portion of the bottom rail adapter extending in the second direction and being received by the first open end of the bottom rail, wherein each of the plurality of apertures receives an end of each of the plurality of slats, and a plurality of inserts coupled to the upright end rail, each insert disposed proximate a respective aperture of the plurality of apertures, each insert received by a respective slat, wherein each insert is biased to exert a force on an internal surface of the respective slat;

wherein the upper insertable portion is received by the first open end of the top rail and further comprises at least one fastener received through the top rail and the upper insertable portion.

18. The railing panel of claim 17 further comprising a midspan support rail defining a plurality of through holes, each of the plurality of slats received through a respective through hole.

19. The railing panel of claim 17 wherein the upper insertable portion is friction fit within the first open end of the top rail and the lower insertable portion is friction fit within the first open end of the bottom rail.

20. The railing panel of claim 17 wherein the hollow tubular structure of the top and bottom rails each comprises a four wall structure.

* * * * *